US007676374B2

(12) United States Patent
Tammi

(10) Patent No.: US 7,676,374 B2
(45) Date of Patent: Mar. 9, 2010

(54) LOW COMPLEXITY SUBBAND-DOMAIN FILTERING IN THE CASE OF CASCADED FILTER BANKS

(75) Inventor: Mikko Tammi, Tampere (FI)

(73) Assignee: Nokia Corporation, Espoo (FI)

( * ) Notice: Subject to any disclaimer, the term of this patent is extended or adjusted under 35 U.S.C. 154(b) by 1012 days.

(21) Appl. No.: 11/390,742

(22) Filed: Mar. 28, 2006

(65) Prior Publication Data

US 2007/0233466 A1 Oct. 4, 2007

(51) Int. Cl.
*G10L 19/00* (2006.01)
*G10L 19/14* (2006.01)

(52) U.S. Cl. ..... 704/500; 704/200.1; 704/205

(58) Field of Classification Search ..... None
See application file for complete search history.

(56) References Cited

U.S. PATENT DOCUMENTS

| | | | | |
|---|---|---|---|---|
| 5,408,580 | A | 4/1995 | Stautner et al. | |
| 5,461,378 | A * | 10/1995 | Shimoyoshi et al. | 341/51 |
| 5,848,164 | A * | 12/1998 | Levine | 381/61 |
| 6,947,509 | B1 * | 9/2005 | Wong | 375/350 |
| 7,110,556 | B2 * | 9/2006 | Aarts et al. | 381/98 |
| 2006/0190247 | A1 * | 8/2006 | Lindblom | 704/230 |
| 2007/0067162 | A1 * | 3/2007 | Villemoes et al. | 704/206 |
| 2007/0179781 | A1 * | 8/2007 | Villemoes | 704/211 |
| 2008/0025519 | A1 * | 1/2008 | Yu et al. | 381/17 |

FOREIGN PATENT DOCUMENTS

| | | |
|---|---|---|
| WO | WO 97/41638 | 11/1997 |
| WO | WO 98/47313 | 10/1998 |
| WO | WO 2005/043511 | 5/2005 |

OTHER PUBLICATIONS

Subband-Domain Filtering on MPEG Audio Signals, Lanciani et al., 1999 IEEE, pp. 917-920.

Lanciani and Schafer, Subband-domain filtering of MPEG audio signals. 1999 IEEE International Conference on Acoustics, Speech and Signal Processing, Proceedings Mar. 15-19, 1999, vol. 2, p. 917-920.

(Continued)

*Primary Examiner*—David R Hudspeth
*Assistant Examiner*—Matthew J Sked
(74) *Attorney, Agent, or Firm*—Foley & Lardner, LLP

(57) ABSTRACT

A filtering method and system for a subband-domain is provided. A first analysis filter bank is configured to divide an input signal into a plurality of subbands. A second analysis filter bank divides one or more of the subbands into a second set of subbands. A modification unit accepts the plurality of subbands, the second set of subbands and modification data and outputs a plurality of modified frequency subbands. A first synthesis filter bank synthesizes the plurality of modified subbands. A filter then filters the plurality of modified subbands and the one or more synthesized modified subbands to obtain a plurality of filtered subbands. A second synthesis filter bank synthesizes the plurality of filtered subbands to obtain an output signal.

35 Claims, 7 Drawing Sheets

OTHER PUBLICATIONS

Herre et al., The Reference model architecture for MPEG spatial audio coding. Audio Engineering Society Convention Paper 6447, presented at the 118$^{th}$ Convention, May 28-31, 2005. Retrieved from the internet at: http://www.iis.fraunhofer.de/fhg/Images/AES6447_MPEG_Spatial_Audio_Reference_Model_Architecture_tcm97-67568.pdf, see section 4.2 and figure 5.

International Search report for PCT Application No. PCT/IB2007/000773.

Touimi, Abdellatif Benjelloun. "A Generic Framework for Filtering in Subband-Domain," In Proc. Of IEEE 9$^{th}$ Wkshp. On Digital Signal Processing, Hunt, Texas, pp. 1-5, 2000.

* cited by examiner

LOW COMPLEXITY SUBBAND-DOMAIN FILTERING IN THE CASE OF CASCADED FILTER BANKS

FIELD OF THE INVENTION

The present invention relates to audio coding and more specifically to a system and method for subband-domain filtering.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

The filter bank is a fundamental component of MPEG audio standard applications. Specifically, a filter bank is used for the time/frequency transformation of the time-domain audio signal. Accordingly, in typical audio coding applications, filter banks are frequently used to divide input signals into subband frequencies (subbands). The subbands are then modified using specific techniques to obtain a desired output signal. In some coding applications, a higher frequency resolution is required than can be obtained from using a single filter bank. In this case, subband frequencies may be further divided into smaller subbands using one or more additional filter banks. Such systems are often referred to as cascading filter bank systems.

Subband-domain filtering operations are also used in typical audio coding applications. Subband-domain filtering may include infinite impulse response (IIR) and finite impulse response (FIR) operations. In a cascading filter bank system, the number of operations required to carry out filtering operations in the subband-domain increases in complexity with every additional filter bank employed. This complexity results in an undesirable and computationally expensive process. Thus, a method and system is needed that reduces the complexity of carrying out subband-domain filtering in a cascading filter bank system.

SUMMARY OF THE INVENTION

According to one embodiment of the invention, a subband-domain filtering system includes an outer analysis filter bank configured to receive an input signal and divide the input signal into a plurality of subbands. An inner analysis filter bank is configured to divide one or more of the subbands into an inner set of subbands. In addition, a modification unit is configured to accept as input the plurality of subbands and the inner set of subbands and modification data. The modification data is used by the modification unit to output a plurality of modified subbands. Further, an inner synthesis filter bank is configured to receive and synthesize a plurality of modified subbands to produce one or more synthesized subbands. A subband-domain filter is configured to filter the plurality of modified subbands and the one or more synthesized subbands to obtain a plurality of filtered subbands. Finally, an outer synthesis filter bank is configured to synthesize the plurality of filtered subbands to obtain an output signal.

According to another embodiment of the invention, a subband-domain filtering system includes an outer analysis filter bank configured to receive an input signal and divide the input signal into a plurality of subbands. An inner analysis filter bank is configured to divide one or more of the subbands into an inner set of subbands. In addition, a modification unit is configured to accept as input the plurality of subbands and the inner set of subbands and modification data. The modification data is used by the modification unit to output a plurality of modified subbands. Further, a subband-domain filter is configured to filter the plurality of modified subbands to obtain a plurality filtered subbands. In addition, an inner synthesis filter bank is configured to synthesize the plurality of filtered subbands to produce a synthesized subband. Finally, an outer synthesis filter bank is configured to synthesize the plurality of filtered subbands and the synthesized subband to obtain an output signal.

According to still another embodiment of the invention, a method for filtering in a subband-domain includes first receiving an input signal. Next, the input signal is divided into a plurality of subbands. Then, one or more of the subbands is further divided into an inner set of subbands. The subbands and the inner set of subbands are then modified based on a plurality of given data to obtain a plurality of modified subbands. Next, one or more of the modified subbands is synthesized. Then the plurality of modified subbands and the one or more synthesized subbands is filtered to obtain a plurality of filtered subbands. Finally, the plurality of filtered subbands is filtered to obtain an output signal.

According to still another embodiment of the present invention a method for filtering in a subband-domain includes first receiving an input signal. Then, the input signal is divided into a plurality of subbands. Next, one or more of the subbands is further divided into an inner set of subbands. The subbands and the inner set of subbands are then modified based on a plurality of data to obtain a plurality of modified subbands. Next, the plurality of modified subbands is filtered to obtain a plurality of filtered subbands. Then, one or more of the filtered subbands is synthesized to obtain a plurality of synthesized subbands. Finally, the filtered subbands and the plurality of synthesized subbands are synthesized to obtain an output signal.

The present invention has several advantages over conventional systems. The present invention provides an efficient system and method for carrying out subband-domain filtering operations. For example, the system and method significantly reduce the computational complexity of the subband-domain filtering process in cascading filter bank systems. This reduction in computational complexity results in an increase of speed in filtering systems such as audio or video coding applications.

These and other advantages and features of the invention, together with the organization and manner of operation thereof, will become apparent from the following detailed description when taken in conjunction with the accompanying drawings, wherein like elements have like numerals throughout the several drawings described below.

DETAILED DESCRIPTION OF THE PREFERRED EMBODIMENTS

Embodiments of the present invention will be described below with reference to the accompanying drawings. It should be understood that the following description is intended to describe exemplary embodiments of the invention, and not to limit the invention.

Figure 1:
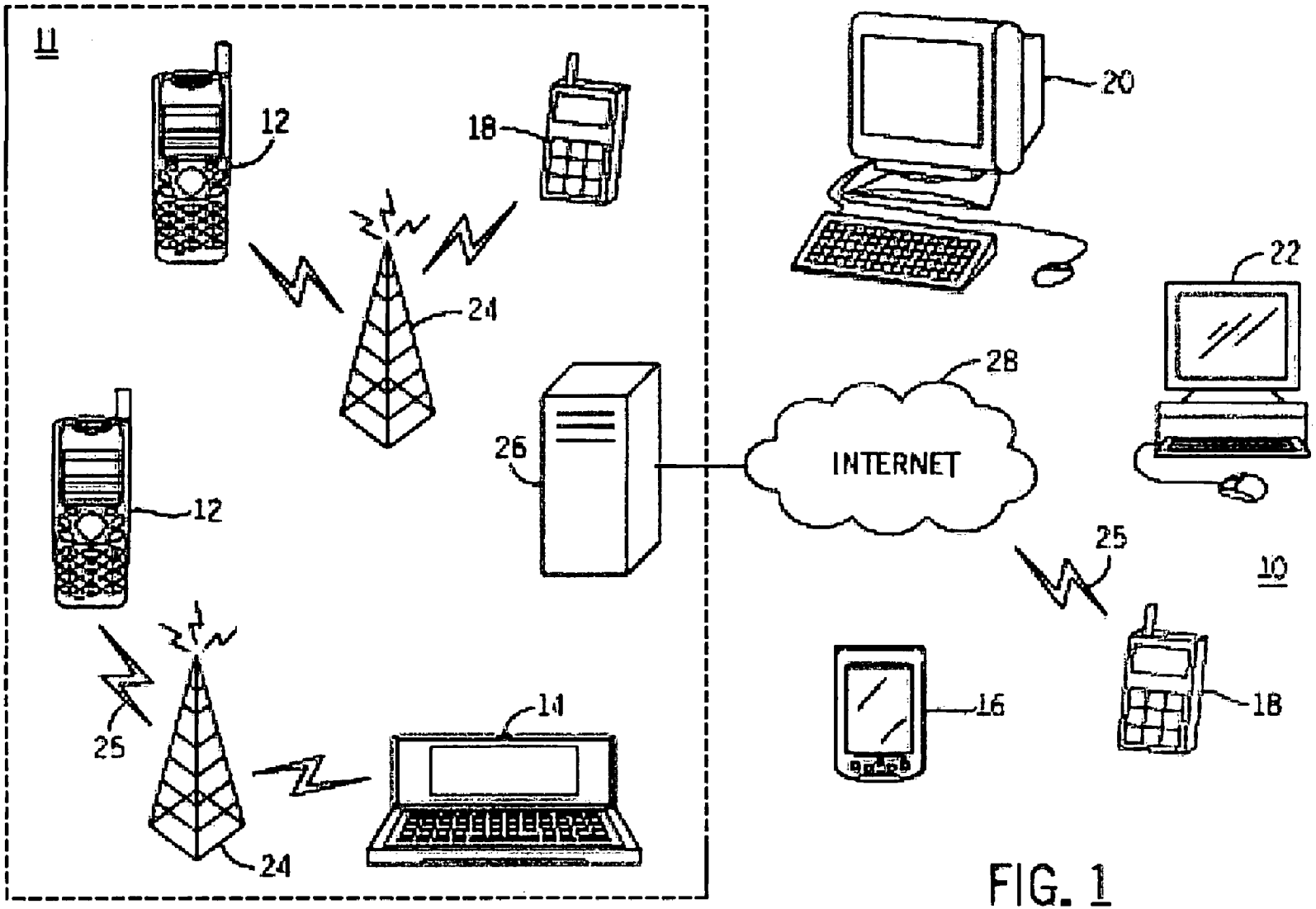
FIG. 1 is an overview diagram of a system within which the present invention may be implemented.

FIG. 1 shows a system 10 in which the present invention can be utilized, comprising multiple communication devices that can communicate through a network. The system 10 may comprise any combination of wired or wireless networks including, but not limited to, a mobile telephone network, a wireless Local Area Network (LAN), a Bluetooth personal area network, an Ethernet LAN, a token ring LAN, a wide area network, the Internet, etc. The system 10 may include both wired and wireless communication devices.

For exemplification, the system 10 shown in FIG. 1 includes a mobile telephone network 11 and the Internet 28. Connectivity to the Internet 28 may include, but is not limited to, long range wireless connections, short range wireless connections, and various wired connections including, but not limited to, telephone lines, cable lines, power lines, and the like.

The exemplary communication devices of the system 10 may include, but are not limited to, a mobile telephone 12, a combination PDA and mobile telephone 14, a PDA 16, an integrated messaging device (IMD) 18, a desktop computer 20, and a notebook computer 22. The communication devices may be stationary or mobile as when carried by an individual who is moving. The communication devices may also be located in a mode of transportation including, but not limited to, an automobile, a truck, a taxi, a bus, a boat, an airplane, a bicycle, a motorcycle, etc. Some or all of the communication devices may send and receive calls and messages and communicate with service providers through a wireless connection 25 to a base station 24. The base station 24 may be connected to a network server 26 that allows communication between the mobile telephone network 11 and the Internet 28. The system 10 may include additional communication devices and communication devices of different types.

The communication devices may communicate using various transmission technologies including, but not limited to, Code Division Multiple Access (CDMA), Global System for Mobile Communications (GSM), Universal Mobile Telecommunications System (UMTS), Time Division Multiple Access (TDMA), Frequency Division Multiple Access (FDMA), Transmission Control Protocol/Internet Protocol (TCP/IP), Short Messaging Service (SMS), Multimedia Messaging Service (MMS), e-mail, Instant Messaging Service (IMS), Bluetooth, IEEE 802.11, etc. A communication device may communicate using various media including, but not limited to, radio, infrared, laser, cable connection, and the like.

Figure 2:
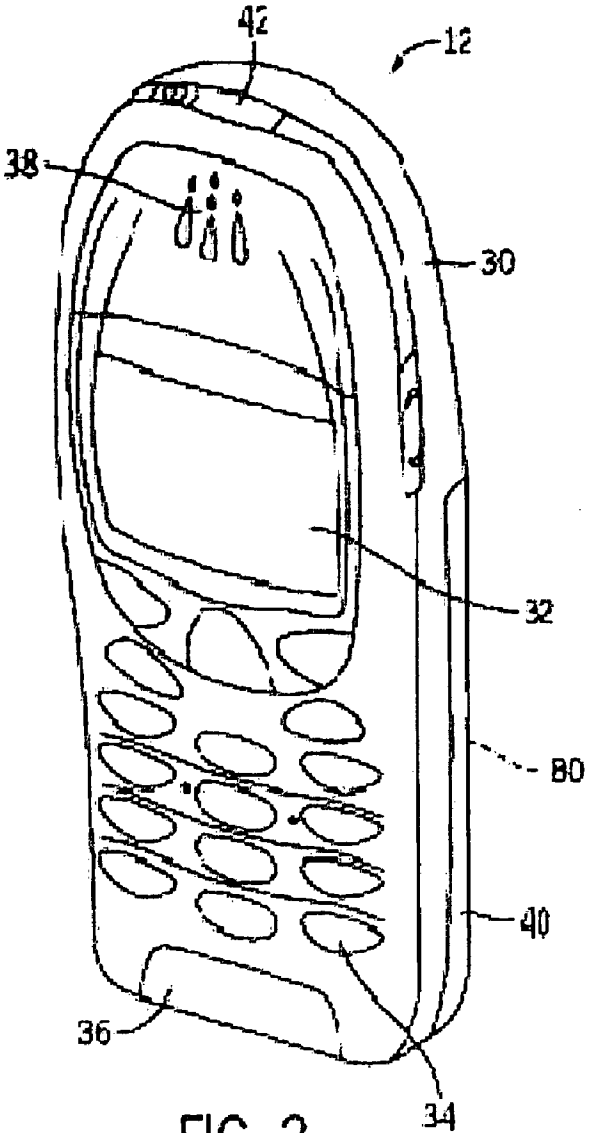
FIG. 2 is a perspective view of a mobile telephone that can be used in the implementation of the present invention.
Figure 3:
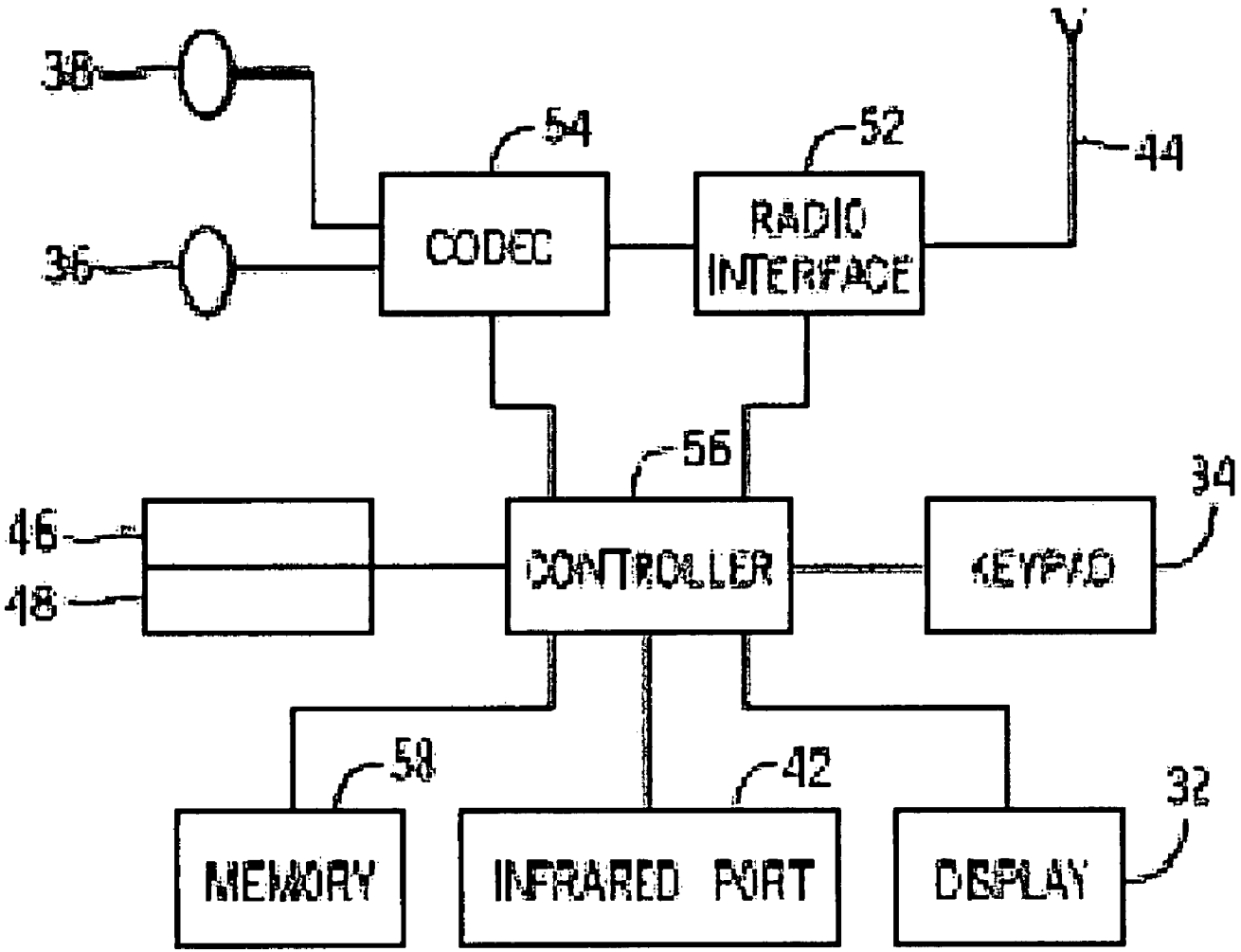
FIG. 3 is a schematic representation of the telephone circuitry of the mobile telephone of FIG. 2.

FIGS. 2 and 3 show one representative mobile telephone 12 within which the present invention may be implemented. It should be understood, however, that the present invention is not intended to be limited to one particular type of mobile telephone 12 or other electronic device. The mobile telephone 12 of FIGS. 2 and 3 includes a housing 30, a display 32 in the form of a liquid crystal display, a keypad 34, a microphone 36, an ear-piece 38, a battery 40, an infrared port 42, an antenna 44, a smart card 46 in the form of a UICC according to one embodiment of the invention, a card reader 48, radio interface circuitry 52, codec circuitry 54, a controller 56 and a memory 58. Individual circuits and elements are all of a type well known in the art, for example in the Nokia range of mobile telephones.

Figure 4:
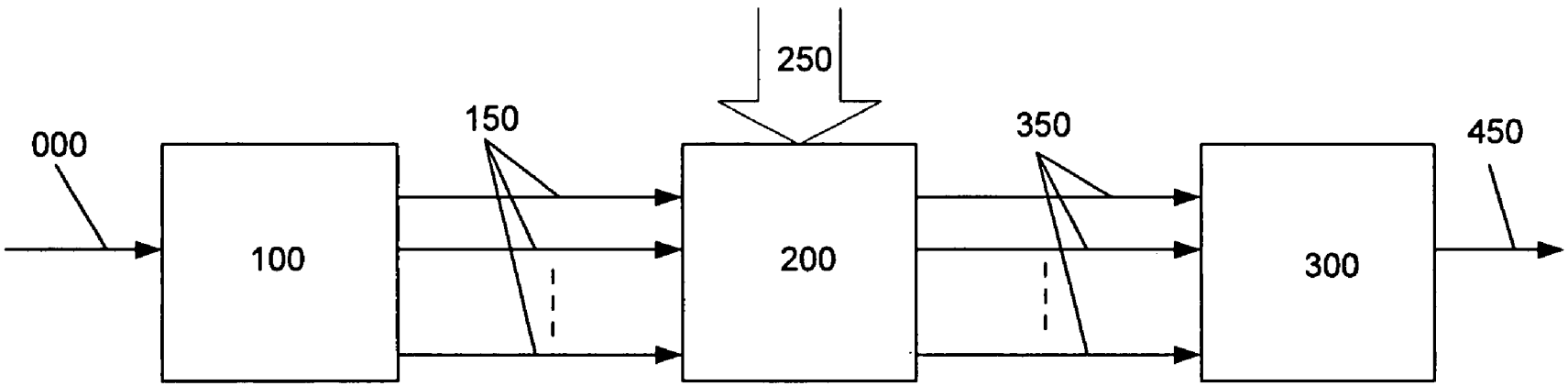
FIG. 4 is a block diagram of a conventional subband filtering system and method.

A conventional subband filtering system and method is illustrated in FIG. 4. FIG. 4 shows two filter banks and a modification unit. First, a filter bank must receive an input signal 000 (e.g., an audio signal, video signal, etc.). A filter bank is an array of band-pass filters (not shown) that may be used to divide the input signal 000 into several components wherein each component carries a single frequency subband 150 of the original input signal 000. The process of dividing a single input signal 000 into a plurality of subbands 150 is typically referred to as analysis and is carried out by a specific type of filter bank referred to as an analysis filter bank 100. Here, for example, the filter bank 100 may be a known pseudo-QMF filter bank.

Generally, filter banks are also designed so that at some point in time, the subbands 150 can be recombined to form a single output signal 450. This process is referred to as synthesis and is carried out by a synthesis filter bank 300 shown in FIG. 4. The synthesis filter bank 300 will be discussed in greater detail after modifications to the subbands 150 are described.

As shown in FIG. 4, once the analysis filter bank 100 divides an input signal 000 into subbands 150, a modification unit 200 is used to modify the subbands 150. For example, the modification unit 200 may identify important frequencies and unimportant frequencies of the input signal 000 represented by the subbands 150. Presumably, the modification unit 200 is provided with data 250 that will affect how the subbands 150 are modified (e.g., the importance of each subband to the output signal). This information can then be used by the modification unit 200 for modifying (e.g., coding, magnitude scaling, envelope and phase modification or decorrelation with other signals) the subbands 150. For example, those subband frequencies deemed unimportant may be dropped, while those subband frequencies deemed important may be coded at a higher resolution to preserve signal integrity and sound quality. According to one embodiment of the invention, the modification unit 200 is a subband domain coder that uses original filter bank coefficients as its input and outputs a coded (synthesized) version of the coefficients.

Once modifications of the subbands 150 have been completed to create modified frequency subbands 350, as shown in FIG. 4, those modified frequency subbands 350 are synthesized. For synthesis, a synthesis filter bank 300 receives the modified frequency subbands 350 as input and reconstructs the modified frequency subbands 350 to create an output signal 450.

Figure 5:
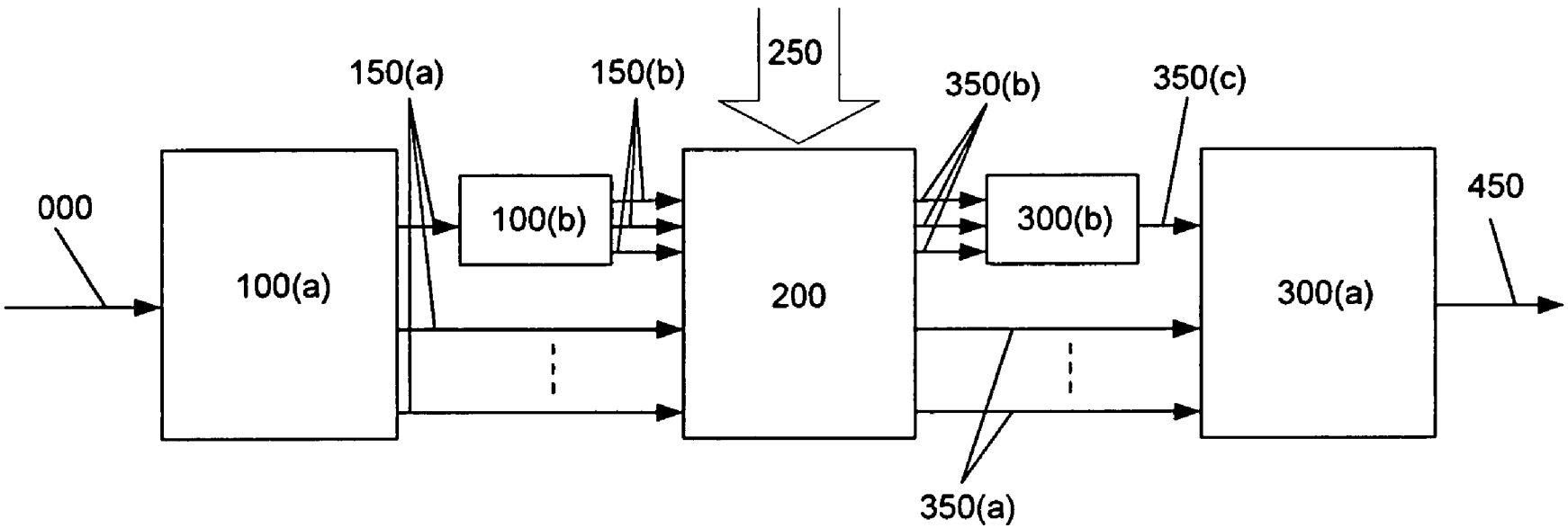
FIG. 5 is a block diagram of a conventional subband filtering system and method with a cascading filter bank system.

In many applications, including audio coding, higher frequency resolution is needed for certain subbands. In order to achieve this, it is common to further divide desired subbands utilizing one or more additional filter banks. This is known as a cascading filter bank system and is illustrated, for example, in FIG. 5. It should be understood that the cascading system can contain any number of filter banks and that the system shown in FIG. 5 is shown for example purposes and to simplify the discussion. As shown in FIG. 5, an outer analysis filter bank 100(*a*) accepts an input signal 000. The outer analysis filter bank 100(*a*) then divides the input signal 000 into a plurality of subbands 150(*a*). Next, one or more of the subbands 150(*a*) are input into a second or inner analysis filter bank 100(*b*). The inner analysis filter bank 100(*b*) further divides the subbands 150(*a*) into a second or inner set of subbands 150(*b*).

As shown in FIG. 5, the subbands 150(*a*) and inner set of subbands 150(*b*) are input into the modification unit 200. The modification unit 200 modifies the subband frequency inputs 150(*a*) and 150(*b*) based on given data 250 as described above. The modification unit 200 outputs a plurality of modified subbands 350(*a*) and a second or inner set of modified subbands 350(*b*). The inner set of modified subbands 350(*b*) correspond to the inner set of subbands 150(*b*) and are further input into a second or inner synthesis filter bank 300(*b*). The inner synthesis filter bank 300(*b*) reconstructs the inner set of modified subbands 350(*b*) to obtain a synthesized subband 350(*c*). Next, the synthesized subband 350(*c*) and the plurality of modified subbands 350(*a*) are further synthesized by an outer synthesis filter bank 300(*a*) to produce an output signal 450.

According to one embodiment of the invention, it is desirable to further augment the cascading system described above using additional filtering operations in the subband-domain using a subband-domain filter. For example, in audio coding applications a finite impulse response (FIR) filter or an infinite impulse response (IIR) filter may be used as a subband-domain filter.

One objective of filtering subband signals is to generate an output signal equivalent to a signal that would be obtained by reconstructing an unmodified signal, filtering the unmodified signal in the time domain and then recoding it into the subband-domain. In addition, the subband-domain filtering of audio signals has several applications. For example, perceptual effects may be applied to MPEG signals, aliasing before downsampling can be prevented and MPEG signals can be equalized in frequency.

Figure 6:
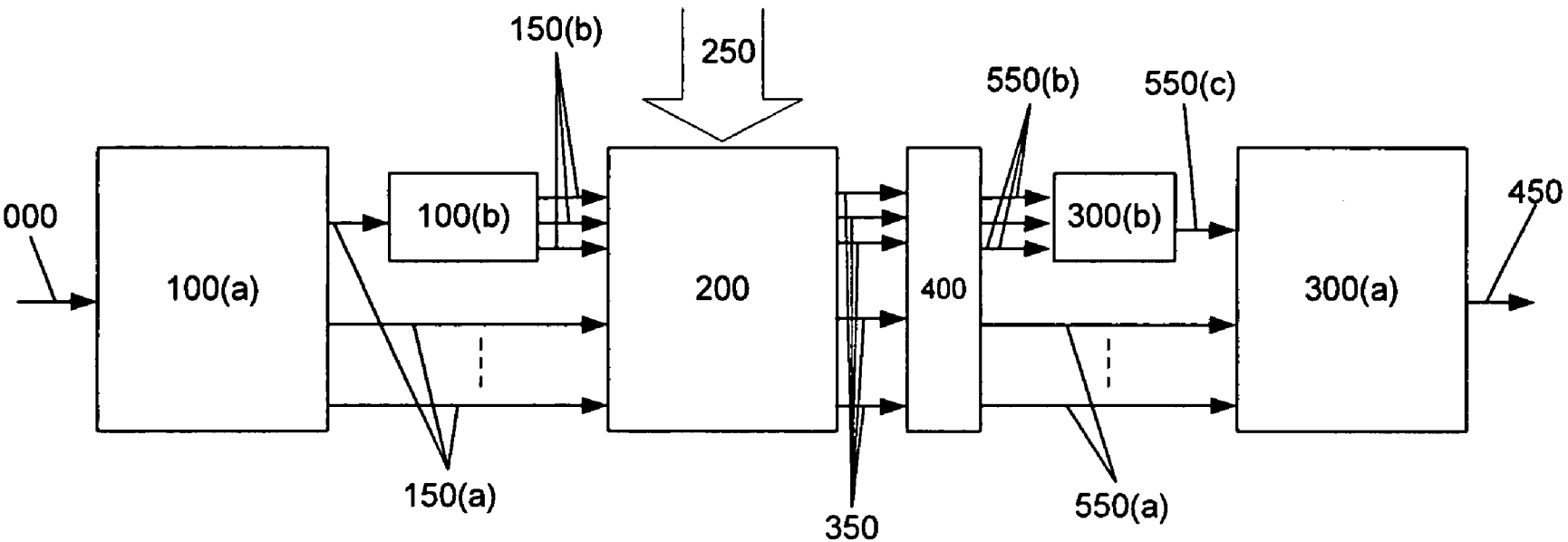
FIG. 6 is a block diagram of a subband-domain filtering system and method for a cascading filter bank system according to one embodiment of the invention.

FIG. 6 shows a cascading filter bank system and method according to one embodiment of the invention. It should be understood that the cascading system can contain any number of filter banks and that the system shown in FIG. 6 is shown for example purposes and to simplify the discussion. First, an outer analysis filter bank 100(*a*) receives an input signal 000. The outer analysis filter bank 100(*a*) divides the input signal 000 into a plurality of subbands 150(*a*). Here, for example the filter bank 100(*a*) may be a known pseudo-QMF filter bank. A second or inner analysis filter bank 100(*b*) receives on or more of the subbands 150(*a*) as input. The inner analysis filter bank 100(*b*) further divides the inputted subbands 150(*a*) into a second or inner set of subbands 150(*b*). The inner set of subbands 150(*b*) and the plurality of subbands 150(*a*) are then provided as input to a modification unit 200.

As shown in FIG. 6, in addition to receiving the subbands 150(*a*) and the inner set of subbands 150(*b*), the modification unit 200 receives data 250 related to how the frequency subbands 150(*a*), 150(*b*) should be modified. This information can then be used by the modification unit 200 to modify (e.g., coding, magnitude scaling) the subbands 150(*a*), 150(*b*). For example, those frequencies deemed unimportant may be dropped while those frequencies deemed important may be coded at a higher resolution to preserve signal integrity and sound quality.

As shown in FIG. 6, once modifications of the frequency subbands 150(*a*), 150(*b*) have been completed to create modified subbands 350, those modified frequency subbands 350 are filtered using a subband-domain filter 400. As described above, the subband-domain filter 400 may be one of any type of FIR filter or IIR filter. The operation and characteristics of the subband-domain filter 400 are determined based on the design specification for the cascading filter bank system and the output signal 450 desired. The subband-domain filter 400 outputs a second or inner set of filtered subbands 550(*b*) that correspond to the inner set of subbands 150(*b*) and a plurality of filtered subbands 550(*a*).

Next, the inner set of filtered subbands 550(*b*) are provided as input into a second or inner synthesis filter bank 300(*b*). The inner synthesis filter bank 300(*b*) reconstructs the second set of filtered subbands 550(*b*) to produce a synthesized subband 550(*c*). As shown in FIG. 6, the synthesized subband 550(*c*) and the plurality of filtered subbands 550(*a*) are then input into an outer synthesis filter bank 300(*a*). The outer synthesis filter bank 300(*a*) reconstructs the inputted signals 550(*a*), 550(*c*) to produce an output signal 450.

Generally, a subband-domain filter 400 can be represented as a matrix operation. Thus, as the number of subband frequencies increase, the number of required computational operations also increases. According to another embodiment of the invention, a cascading filter bank system and method is provided that reduces the complexity encountered when using a subband-domain filter.

Figure 7:
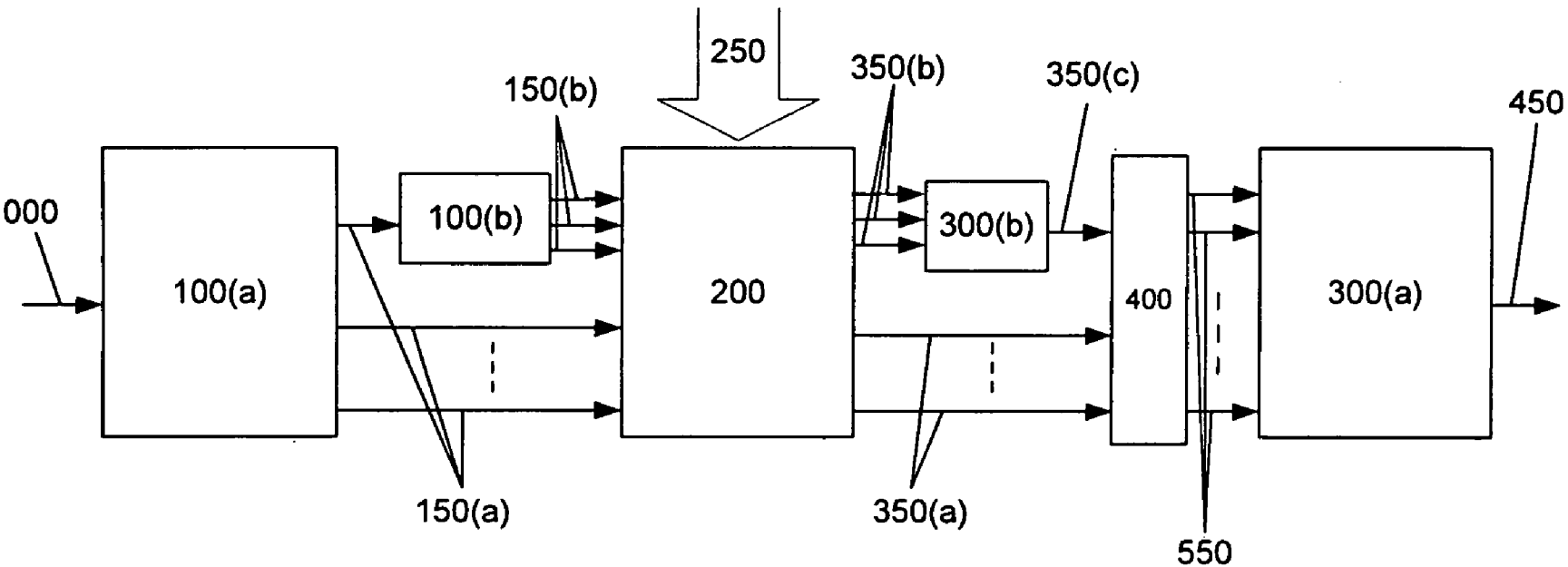
FIG. 7 is a block diagram of a subband-domain filtering system and method for a cascading filter bank system according to another embodiment of the invention.

A cascading filter bank system and method for reducing the operational complexity of filtering in a subband-domain is illustrated in FIG. 7. It should be understood that the cascading system can contain any number of filter banks and that the system shown in FIG. 7 is shown for example purposes only and to simplify the discussion. As discussed above, the system illustrated in FIG. 7 contains an outer analysis filter bank 100(*a*), an inner analysis filter bank 100(*b*) and a modification unit 200. These components and corresponding processes are identical to those described above in reference to FIG. 6.

The modification unit 200 outputs a plurality of modified subbands 350(*a*) and a second or inner set of modified subbands 350(*b*). The inner set of modified subbands 350(*b*) correspond to the inner set of subbands 150(*b*) and are further input into a second or inner synthesis filter bank 300(*b*). The inner synthesis filter bank 300(*b*) reconstructs the inner set of modified subbands 350(*b*) to obtain a synthesized subband 350(*c*). The synthesized subband 350(*c*) and the plurality of modified subbands 350(*a*) are then input into a subband-domain filter 400. As described above, the subband-domain filter 400 may be one of any type of FIR filter or IIR filter.

Because the inner set of modified subbands 350(*b*) were synthesized before being input into the subband-domain filter 400, less operational computations are required. For example, let X(t, k) be the value of subband k (150) of an analysis filter bank 100 at the instant t. Depending on the analysis filter bank, X(t, k) may be a complex number. The filtered signal in the subband domain, Y(t, k) (550), is obtained from the equation:

$$Y(t,k)=\sum_{m=-M_{low}^{k}}^{m=M_{high}^{k}}\sum_{n=-N_{low}^{k}}^{n=N_{high}^{k}}X(t+m,k+n)F_k(m+M_{low}^{k},n+N_{low}^{k})$$

In the above equation, $F_k(m, n)$ is a filter matrix for subband k with $(M_{low}^{k}+M_{high}^{k}+1)$ rows and $(N_{low}^{k}+N_{high}^{k}+1)$ columns, where $M_{low}^{k}$, $N_{low}^{k}$, $M_{high}^{k}$ and $N_{high}^{k}$ are $\geqq 0$. The size of matrix $F_k(m, n)$ depends on the value of k, on the analysis filter bank 100, as well as on the desired accuracy of the filtering operation. Obtaining the filtered signal in the subband-domain Y(t, k) (550) may require a significant number of operations, especially if the subband-domain filter 400 is long or if the parameters of X(t, k) are complex. In a cascaded filter bank system as shown in FIG. 7, the number of subbands that must be filtered can become very large. However, carrying out the filtering operation 400 after synthesizing one or more of the modified subband frequencies 350(*b*) significantly reduces the operational complexity.

Next, the subband-domain filter 400 outputs a plurality of filtered subbands 550 to an outer synthesis filter bank 300(*a*). Finally, the outer synthesis filter bank 300(*a*) reconstructs the filtered subbands to produce an output signal 450. A specific implementation of the above-described system is described below.

According to another embodiment of the invention, the modification unit 200 modifies the amplitude of the inputted subbands 150(*a*), 150(*b*) using gain values. Let X(t,k) be a subband frequency 150(*a*) of the outer analysis filter bank 100(*a*) which is further divided into a inner set of subbands 150(*b*) in the inner analysis filter bank 100(*b*), these bands are denoted as $H_1(t,k), \ldots, H_B(t, k)$. Each one of these bands are scaled in the modification unit 200 with the given gains, resulting in $g_1(t,k)H_1(t,k), \ldots g_B(t,k)H_B(t, k)$.

The modification unit 200 outputs a plurality of modified subbands 350(*a*) and an inner set of modified subband frequencies 350(*b*). The inner set of modified subbands 350(*b*) correspond to the inner set of subbands 150(*b*) and are further input into the inner synthesis filter bank 300(*b*). From the inner synthesis filter bank 300(*b*) a scaled version of the original subband parameter is obtained denoted as $\hat{X}(t,k)$. The total effect of gains $g_1(t,k), \ldots, g_B(t,k)$ on the subband frequencies 150(*a*), 150(*b*) can be estimated as (where G (t,k) may be a complex number):

$$Y(t, k) = \sum_{m=-M_{low}^k}^{m=M_{high}^k} \sum_{n=-N_{low}^k}^{n=N_{high}^k} G(t+m, k+n)X(t+m, k+n)F_k(m+M_{low}^k, n+N_{low}^k)$$

Utilizing the above described method for every subband frequency 150(*a*) of the outer analysis filter bank 100(*a*) for which the inner analysis filter bank 100(*b*) is applied, a gain value for every subband frequency 150(*a*), 150(*b*) of the outer analysis filter bank 100(*a*) is obtained. Next, the amplitude scaling with the gains can efficiently be combined with the filtering operation 400. The filtering equation given now is:

$$G(t, k) = \frac{\hat{X}(t, k)}{X(t, k)}$$

Next, the subband-domain filter 400 outputs a plurality of filtered subbands 550 to an outer synthesis filter bank 300(*a*). The outer synthesis filter bank 300(*a*) then reconstructs the filtered subband frequencies to produce an output signal 450.

According to one embodiment of the invention, an example case which is related to the ongoing standardization of the MPEG Surround decoder is provided below with reference to FIG. 7. First, the input signal 000 is divided into 64 subbands 150(*a*) using a QMF analysis filter bank 100(*a*). At the lowest frequencies, higher frequency resolution is needed and thus a cascaded filter bank structure is used. Utilizing a Nyquist analysis filter bank 100(*b*), the three lowest QMF domain frequency bands are divided into 6, 2, and 2 Nyquist domain bands 150(*b*), respectively.

Gain parameters are now used via the modification unit 200 to scale the subbands as described in paragraph [0042] to set the amplitudes at a desired level. Part of the gain information is for Nyquist domain bands 150(*b*) and the rest for QMF domain bands 150(*a*).

In one operation mode of the MPEG surround coder, the input signal is filtered with a Head Related Transfer Function (HRTF) filter 400. HRTF filters are generally FIR filters which simulate how a given sound wave input (parameterized as frequency and source location) is filtered by the diffraction and reflection properties of the head before the sound reaches the eardrum. A typical HRTF filter 400 has a length of 128 samples at the sampling frequency of 44100 kHz (there are also different filter lengths).

HRTF filtering in the QMF-domain with reasonable accuracy requires for example a filter matrix with $M_{low}^k=4$, $M_{high}^k=4$, $N_{low}^k=1$ and $N_{high}^k=1$. By doing the filtering only in the QMF domain, complexity of the filtering operation can be decreased. The magnitude scaled Nyquist domain subband samples 350(*b*) are fed to corresponding Nyquist synthesis filter banks 300(*b*). The QMF-domain gain values for the first 3 subbands 350(*b*) can now be computed using equation introduced in paragraph [0043]. Now, as we have gain values for every QMF-subband 350(*a*), 350(*c*), HRTF filtering 400 can be performed as described in paragraph [0044].

According to the above-described invention, several advantages are realized. First, an efficient system and method for carrying out subband-domain filtering operations is realized. The system and method significantly reduce the computational complexity of the subband-domain filtering process in cascading filter bank systems. This reduction in computational complexity results in an increase of speed in filtering systems such as audio or video coding applications.

The present invention is described in the general context of method steps, which may be implemented in one embodiment by a program product including computer-executable instructions, such as program code, executed by computers in networked environments. Generally, program modules include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps.

Software and web implementations of the present invention could be accomplished with standard programming techniques with rule based logic and other logic to accomplish the various database searching steps, correlation steps, comparison steps and decision steps. It should also be noted that the words "component" and "module," as used herein and in the claims, is intended to encompass implementations using one or more lines of software code, and/or hardware implementations, and/or equipment for receiving manual inputs.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments and with various modifications as are suited to the particular use contemplated.

What is claimed is:

1. A subband-domain filtering system, comprising:

an inner synthesis filter bank configured to receive and synthesize a plurality of modified subbands to produce one or more synthesized subbands;

a subband-domain filter configured to filter the plurality of modified subbands and the one or more synthesized subbands to obtain a plurality of filtered subbands; and an outer synthesis filter bank configured to synthesize the plurality of filtered subbands to obtain an output signal.

2. A subband-domain filtering system according to claim 1, further comprising:

an outer analysis filter bank configured to receive an input signal and divide the input signal into a plurality of subbands;

an inner analysis filter bank configured to divide one or more of the subbands into an inner set of subbands; and a modification unit configured to accept as input the plurality of subbands and the inner set of subbands and modification data, wherein the modification data is used by the modification unit to output the plurality of modified subbands.

3. A subband-domain filtering system according to claim 2, wherein the modification unit is configured to implement magnitude scaling, coding, envelope and phase modification or decorrelation with other signals upon the plurality of subbands and the inner set of subbands.

4. A subband-domain filtering system, comprising:

an outer analysis filter bank configured to receive an input signal and divide the input signal into a plurality of subbands;

an inner analysis filter bank configured to divide one or more of the subbands into an inner set of subbands;

a modification unit configured to accept as input the plurality of subbands and the inner set of subbands and modification data, wherein the modification data is used by the modification unit to output a plurality of modified subbands;

an inner synthesis filter bank configure to receive and synthesize a plurality of modified subbands to produce one or more synthesized subbands;

a subband-domain filter configured to filter the plurality of modified subbands and the one or more synthesized subbands to obtain a plurality of filtered subbands; and an outer synthesis filter bank configured to synthesize the plurality of filtered subbands to obtain an output signal.

5. A subband-domain filtering system, comprising:

an outer analysis filter bank configured to receive an input signal and divide the input signal into a plurality of subbands;

an inner analysis filter bank configured to divide one or more of the subbands into an inner set of subbands;

a modification unit configured to accept as input the plurality of subbands and the inner set of subbands and modification data, wherein the modification data is used by the modification unit to output a plurality of modified subbands;

a subband-domain filter configured to filter the plurality of modified subbands to obtain a plurality filtered subbands;

an inner synthesis filter bank configured to synthesize the plurality of filtered subbands to produce a synthesized subband; and an outer synthesis filter bank configured to synthesize the plurality of filtered subbands and the synthesized subband to obtain an output signal.

6. A method for filtering in a subband-domain, comprising:

providing a plurality of modified subbands;

synthesizing one or more of the modified subbands;

filtering the plurality of modified subbands and the one or more synthesized subbands to obtain a plurality of filtered subbands; and synthesizing the plurality of filtered subbands to obtain an output signal.

7. A method for filtering in a subband-domain as claimed in claim 6, wherein the synthesizing of the one or more of the modified subbands is performed using an inner synthesis filter bank.

8. A method for filtering in a subband-domain as claimed in claim 6, wherein the synthesizing of the plurality of filtered subbands to obtain an output signal is performed using an outer synthesis filter bank.

9. A method for filtering in a subband-domain as claimed in claim 6, wherein providing a plurality of modified subbands further comprises:

receiving an input signal;

dividing the input signal into a plurality of subbands;

further dividing one or more of the subbands into an inner set of subbands; and modifying the subbands and the inner set of subbands based on a plurality of given data to obtain the plurality of modified subbands.

10. A method for filtering in a subband-domain as claimed in claim 9, wherein the dividing of the input signal into a plurality of subbands is performed by an outer analysis filter bank.

11. A method for filtering in a subband-domain as claimed in claim 9, wherein the dividing of the one or more subbands into an inner set of subbands is performed by an inner analysis filter bank.

12. A method for filtering in a subband-domain as claimed in claim 9, wherein modifying the subbands and the inner set of subbands includes implementing magnitude scaling, coding, envelope and phase modification or decorrelation with other signals on the subbands and the inner set of subbands based on the plurality of given data.

13. A method for filtering in a subband-domain as claimed in claim 9, wherein modifying the subbands and the inner set of subbands comprises modifying the subbands and the inner set of subbands using gain values.

14. A method for filtering in a subband-domain, comprising:

receiving an input signal;

dividing the input signal into a plurality of subbands;

further dividing one or more of the subbands into an inner set of subbands;

modifying the subbands and the inner set of subbands based on a plurality of given data to obtain a plurality of modified subbands;

synthesizing one or more of the modified subbands;

filtering the plurality of modified subbands and the one or more synthesized subbands to obtain a plurality of filtered subbands; and synthesizing the plurality of filtered subbands to obtain an output signal.

15. A method for filtering in a subband-domain, comprising:

receiving an input signal;

dividing the input signal into a plurality of subbands;

further dividing one or more of the subbands into an inner set of subbands;

modifying the subbands and the inner set of subbands based on a plurality of data to obtain a plurality of modified subbands;

filtering the plurality of modified subbands to obtain a plurality of filtered subbands;

synthesizing one or more of the filtered subbands to obtain a plurality of synthesized subbands; and further synthesizing the filtered subbands and the plurality of synthesized subbands to obtain an output signal.

16. A computer program product, embodied in a computer readable medium, comprising:

computer code for providing a plurality of modified subbands;

computer code for synthesizing one or more of the modified subbands;

computer code for filtering the plurality of modified subbands and the one or more synthesized subbands to obtain a plurality of filtered subbands; and computer code for synthesizing the plurality of filtered subbands to obtain an output signal.

17. A computer program product, embodied in a computer readable medium, as claimed in claim 16, wherein the computer code for the synthesizing of the one or more of the modified subbands is performed using an inner synthesis filter bank.

18. A computer program product, embodied in a computer readable medium, as claimed in claim 16, wherein the computer code for the synthesizing of the plurality of filtered subbands to obtain an output signal is performed using an outer synthesis filter bank.

19. A computer program product, embodied in a computer readable medium, as claimed in claim 16, wherein computer code for providing a plurality of modified subbands further comprises:

computer code for receiving an input signal;

computer code for dividing the input signal into a plurality of subbands;

computer code for further dividing one or more of the subbands into an inner set of subbands; and computer code for modifying the subbands and the inner set of subbands based on a plurality of given data to obtain the plurality of modified subbands.

20. A computer program product, embodied in a computer readable medium, as claimed in claim 19, wherein the computer code for the dividing of the input signal into a plurality of subbands is performed by an outer analysis filter bank.

21. A computer program product, embodied in a computer readable medium, as claimed in claim 19, wherein the computer code for the dividing of the one or more subbands into an inner set of subbands is performed by an inner analysis filter bank.

22. A computer program product, embodied in a computer readable medium, as claimed in claim 19, wherein the computer code for modifying the subbands and the inner set of subbands includes computer code for implementing magnitude scaling, coding, envelope and phase modification or decorrelation with other signals on the subbands and the inner set of subbands based on the plurality of given data.

23. A computer program product, embodied in a computer readable medium, as claimed in claim 19, wherein the computer code for modifying comprises modifying the subbands and the inner set of subbands using gain values.

24. A computer program product, embodied in a computer readable medium, comprising:

computer code for receiving an input signal;

computer code for dividing the input signal into a plurality of subbands;

computer code for further dividing one or more of the subbands into an inner set of subbands;

computer code for modifying the subbands and the inner set of subbands based on a plurality of given data to obtain a plurality of modified subbands;

computer code for synthesizing one or more of the modified subbands;

computer code for filtering the plurality of modified subbands and the one or more synthesized subbands to obtain a plurality of filtered subbands; and computer code for synthesizing the plurality of filtered subbands to obtain an output signal.

25. A computer program product, embodied in a computer readable medium, comprising:

computer code for receiving an input signal;

computer code for dividing the input signal into a plurality of subbands;

computer code for further dividing one or more of the subbands into an inner set of subbands;

computer code for modifying the subbands and the inner set of subbands based on a plurality of data to obtain a plurality of modified subbands;

computer code for filtering the plurality of modified subbands to obtain a plurality of filtered subbands;

computer code for synthesizing one or more of the filtered subbands to obtain a plurality of synthesized subbands; and computer code for further synthesizing the filtered subbands and the plurality of synthesized subbands to obtain an output signal.

26. An electronic device, comprising:

a processor; and a memory unit, including:

computer code for providing a plurality of modified subbands;

computer code for synthesizing one or more of the modified subbands;

computer code for filtering the plurality of modified subbands and the one or more synthesized subbands to obtain a plurality of filtered subbands; and computer code for synthesizing the plurality of filtered subbands to obtain an output signal.

27. An electronic device as claimed in claim 26, wherein the computer code for synthesizing the one or more of the modified subbands is performed using an inner synthesis filter bank.

28. An electronic device as claimed in claim 26, wherein the computer code for synthesizing the plurality of filtered subbands to obtain an output signal is performed using an outer synthesis filter bank.

29. An electronic device as claimed in claim 26, wherein the memory further comprises:

computer code for receiving an input signal;

computer code for dividing the input signal into a plurality of subbands;

computer code for further dividing one or more of the subbands into an inner set of subbands; and computer code for modifying the subbands and the inner set of subbands based on a plurality of given data to obtain the plurality of modified subbands.

30. An electronic device as claimed in claim 29, wherein the computer code for dividing the input signal into a plurality of subbands is performed by an outer analysis filter bank.

31. An electronic device as claimed in claim 29, wherein the computer code for dividing the one or more subbands into an inner set of subbands is performed by an inner analysis filter bank.

32. An electronic device as claimed in claim 29, wherein the computer code for modifying the subbands and the inner set of subbands includes computer code for implementing magnitude scaling, coding, envelope and phase modification or decorrelation with other signals on the subbands and the inner set of subbands based on the plurality of given data.

33. An electronic device as claimed in claim 29, wherein the computer code for modifying the subbands and the inner set of subbands comprises computer code for modifying the subbands and the inner set of subbands using gain values.

34. An electronic device, comprising:

a processor; and a memory, including:

computer code for receiving an input signal;

computer code for dividing the input signal into a plurality of subbands;

computer code for further dividing one or more of the subbands into an inner set of subbands;

computer code for modifying the subbands and the inner set of subbands based on a plurality of given data to obtain a plurality of modified subbands;

computer code for synthesizing one or more of the modified subbands;

computer code for filtering the plurality of modified subbands and the one or more synthesized subbands to obtain a plurality of filtered subbands; and computer code for synthesizing the plurality of filtered subbands to obtain an output signal.

35. An electronic device, comprising:

a processor; and a memory, including:

computer code for receiving an input signal;

computer code for dividing the input signal into a plurality of subbands;

computer code for further dividing one or more of the subbands into an inner set of subbands;

computer code for modifying the subbands and the inner set of subbands based on a plurality of data to obtain a plurality of modified subbands;

computer code for filtering the plurality of modified subbands to obtain a plurality of filtered subbands;

computer code for synthesizing one or more of the filtered subbands to obtain a plurality of synthesized subbands; and computer code for further synthesizing the filtered subbands and the plurality of synthesized subbands to obtain an output signal.

* * * * *